US009301366B2

(12) United States Patent
Lee et al.

(10) Patent No.: US 9,301,366 B2
(45) Date of Patent: Mar. 29, 2016

(54) APPARATUS FOR DRIVING LIGHT-EMITTING DIODES

(71) Applicant: RFSEMI TECHNOLOGIES, INC., Daejeon (KR)

(72) Inventors: Jin hyo Lee, Daejeon (KR); Kyu hong Lee, Daejeon (KR)

(73) Assignee: RFSEMI TECHNOLOGIES, INC., Daejeon (KR)

( * ) Notice: Subject to any disclaimer, the term of this patent is extended or adjusted under 35 U.S.C. 154(b) by 0 days.

(21) Appl. No.: 14/760,475

(22) PCT Filed: Feb. 26, 2014

(86) PCT No.: PCT/KR2014/001595

§ 371 (c)(1),
(2) Date: Jul. 12, 2015

(87) PCT Pub. No.: WO2014/137099

PCT Pub. Date: Sep. 12, 2014

(65) Prior Publication Data

US 2015/0366009 A1 Dec. 17, 2015

(30) Foreign Application Priority Data

Mar. 6, 2013 (KR) ..... 10-2013-0023885

(51) Int. Cl.
*H05B 37/02* (2006.01)
*H05B 33/08* (2006.01)

(52) U.S. Cl.
CPC ..... *H05B 33/089* (2013.01); *H05B 33/0815* (2013.01)

(58) Field of Classification Search
CPC ..... H05B 33/089; H05B 33/0884
USPC ..... 315/186, 306, 307, 250, 299
See application file for complete search history.

(56) References Cited

U.S. PATENT DOCUMENTS

2012/0262075 A1* 10/2012 Lynch ..... H05B 33/0818 315/192
2012/0299492 A1* 11/2012 Egawa ..... H05B 33/083 315/192
2012/0313541 A1* 12/2012 Egawa ..... H05B 33/0827 315/201

FOREIGN PATENT DOCUMENTS

JP 2011-216758 A 10/2011
JP 2012-133971 A 7/2012
KR 20-2010-0006345 U 6/2010
KR 10-2011-0090201 A 8/2011

* cited by examiner

*Primary Examiner* — Daniel D Chang
(74) *Attorney, Agent, or Firm* — Drinker Biddle & Reath LLP

(57) ABSTRACT

An apparatus for driving light-emitting diodes includes first and second light-emitting diode auxiliary drive parts for controlling the lighting of first and second light-emitting diode parts depending on the currents flowing through the first and second light-emitting diode parts, respectively detected by first and second resistors. Each of the first light-emitting diode auxiliary drive part and the second light-emitting diode auxiliary drive part includes a first transistor, a second transistor, and a third transistor.

7 Claims, 11 Drawing Sheets

APPARATUS FOR DRIVING LIGHT-EMITTING DIODES

FIELD

The present disclosure relates to an apparatus for driving light emitting diodes.

BACKGROUND

Similar to a general diode, a light emitting diode (LED) has a characteristic of emitting light when a certain condition is satisfied, namely, when a forward voltage is applied and the magnitude of the applied voltage is equal to or greater than that of a threshold voltage, the LED is turned on and current flows in the light-emitting diode, whereby light is emitted.

An AC direct-type light-emitting diode, which is directly driven by the voltage of an AC power source, (hereinafter, referred to 'power voltage') is connected to a full-wave rectifier, and in this case, one or more light-emitting diodes are connected in series, or in series-parallel, which is the combination of series and parallel connection structures.

As described above, when a voltage greater than a turn-on voltage is applied, a light-emitting diode is turned on and a current flows through the light-emitting diode, whereas a voltage less than the turn-on voltage is applied, the light-emitting diode is turned off and a current does not flow in the diode.

Accordingly, based on one power voltage cycle, the turn-on time of the light-emitting diode is short, thus, the amount of light emitted from the light-emitting diode decreases and total harmonic distortion occurs.

When the number of series-connected light-emitting diodes increases, the voltage required for turning on the light-emitting diodes also increases and the turn-on time of the light-emitting diodes is shorter. The reduction in the amount of the emitted light and total harmonic distortion become severe, and it may lead to the increase in manufacturing cost.

Conversely, when the number of series-connected light-emitting diodes decreases, the voltage for driving the light-emitting diodes decreases but an overcurrent flows in the light-emitting diodes. The life of the light-emitting diode is greatly decreased, and overcurrent occurs depending on the variation of the AC voltage.

Therefore, it is necessary to develop a light-emitting diode driving apparatus that is not affected by variation of power voltage, increases the amount of emitted light, prevents overcurrent, and decreases the manufacturing cost.

FIG. 1 illustrates a light-emitting driving circuit in which an AC power source AC, a rectification diode part Dr, a current regulating resistor Rr, and a light-emitting diode part De that has a plurality of serial-connected light-emitting diodes are connected in series.

FIG. 2 illustrates the waveform of the voltage $V_{AC}$ of the AC power (hereinafter, referred to 'power voltage') applied in FIG. 1, the waveform of the current $I_{AC}$ of the AC power, the waveform of the rectified voltage $V_{CC}$ rectified by the rectification diode part Dr, and the waveform of the rectified current $I_{CC}$ that flows in the light-emitting diode part De.

As shown FIG. 1, when the power voltage $V_{AC}$ passes through the rectification diode part Dr, the power voltage is full-wave rectified, and the full-wave rectified voltage $V_{CC}$ is applied to the light-emitting diode part De via the resistor Rr.

When the magnitude of the rectified voltage $V_{CC}$ is equal to or less than the total forward threshold voltage Vth1 of the light-emitting diode part De that has a plurality of series-connected light-emitting diodes, (namely, the total of the forward threshold voltages of the light-emitting diodes each), the light-emitting diode part De is turned off during a certain time (t1, t3) and a current $I_{CC}$ does not flow in the light-emitting diode part De, as shown in FIG. 2.

However, when the magnitude of the rectified voltage $V_{CC}$ is greater than the forward threshold voltage Vth1 (t2), the light-emitting diode part De is turned on and the current $I_{cc}$ starts to flow through the light-emitting diode part De. In this case, the magnitude of the current $I_{CC}$ corresponds to a value that is obtained by dividing the difference between the rectified voltage $V_{CC}$ and the forward threshold voltage Vth1 by the resistance of the resistor Rr. Therefore, if the rectified voltage $V_{CC}$ increases, there is a problem that the current flowing in the light-emitting diode part De becomes greater than a maximum allowable current.

Because the magnitude of the voltage required for the turn-on operation of the light-emitting diode part De, namely, the magnitude of the forward threshold voltage Vth increases with the number of series-connected light-emitting diodes, the turn-on time of the light-emitting diode part De is shorter.

Accordingly, the magnitude of total harmonic distortion increases and the amount of light emitted from the light-emitting diode part De decreases.

When the forward threshold voltage Vth1 of the light-emitting diode part De decreases or when the power voltage $V_{AC}$ increases, a current greater than an allowable current may flow in the light-emitting diode part De, thus the life of the light-emitting diode part De is reduced and the reliability of the operation of the light-emitting diode part is decreased.

Globally, total harmonic distortion that causes various electrical noises is the target of regulations, and when the amount of the emitted light of the light-emitting diode part De is reduced, more light-emitting diodes must be used to compensate for the reduced amount of the emitted light, thus the manufacturing cost of a lighting device having the light-emitting diodes is increased.

Next, FIG. 3 illustrates a light-emitting diode driving circuit for improving total harmonic distortion.

Referring to FIG. 3, a power source AC is connected in series with a current regulating resistor R, a first light-emitting diode part Da, and a second light-emitting diode part Db. The first light-emitting diode part Da has two light-emitting diodes Da1 and Da2, which are connected in anti-parallel, and the second light-emitting diode part Db also has two light-emitting diodes Db1 and Db2, which are connected in anti-parallel.

In the light-emitting diode driving circuit illustrated in FIG. 3, in order to improve total harmonic distortion, a capacitor C1 is connected to a connection point na between the resistor R and the first light-emitting diode part Da, and to a connection point nb between the first light-emitting diode part Da and the second light-emitting diode part Db; and the power voltage $V_{AC}$ is connected to the first and second light-emitting diode parts Da and Db via resistor R, without a rectifier.

FIG. 4 illustrates the waveforms of the power voltage $V_{AC}$ and the current $I_{AC}$, which are applied to the first and second light-emitting diode parts Da and Db of FIG. 3, and the waveform of a voltage $V_R$ that passes through the resistor R, the waveform of a current $I_{Da}$ flowing in the first light-emitting diode part Da, and the waveform of a current $I_{Db}$ flowing in the second light-emitting diode part Db.

When the magnitude of the voltage $V_R$ is less than a forward threshold voltage Vth2, a current does not flow in the first light-emitting diode part Da, and when the magnitude of the voltage $V_R$ is equal to or greater than the total forward threshold voltage Vth2, the current $I_{Da2}$ flows in the forward light-emitting diode Da2 of the first light-emitting diode part Da during a positive (+) half cycle of the power voltage $V_{AC}$, and the current $I_{Da1}$ flows in the backward light-emitting diode Da1 of the first light-emitting diode part Da during a negative (−) half cycle of the power voltage $V_{AC}$, whereby they form the current $I_{Da}$ of the first light-emitting diode part.

If the magnitude of the voltage $V_R$ is less than the forward threshold voltage Vth2, a charging current flows in the second light-emitting diode part Db through the capacitor C1 while the power voltage $V_{AC}$ increases in a positive (+) direction, and a discharging current flows also through the capacitor C1 while the power voltage $V_{AC}$ decreases in a negative (−) direction.

When the magnitude of the voltage $V_R$ is equal to or greater than the forward threshold voltage Vth2, the current $I_{Db2}$ flows in the forward light-emitting diode Db2 of the second light-emitting diode part Db via the forward light-emitting diode Da2 of the first light-emitting diode part Da during a positive (+) half cycle of the power voltage $V_{AC}$, and the current $I_{Db1}$ flows in the backward light-emitting diode Db1 of the second light-emitting diode part Db via the backward light-emitting diode Da1 of the first light-emitting diode part Da during a negative (−) half cycle of the power voltage $V_{AC}$, whereby they form the current $I_{Db}$ of the second light-emitting diode part.

However, when the power voltage $V_{AC}$ decreases, a current does not flow through the capacitor C1, and when the magnitude of the voltage $V_R$ is less than the forward threshold voltage Vth2, a current does not flow in the second light-emitting diode part Db such as in the first light-emitting diode part Da.

When the power voltage $V_{AC}$ increases, a charging-discharging current is generated in the capacitor C1 through the second light-emitting diode part Db, whereby total harmonic distortion of the current $I_{AC}$ that flows in the power voltage $V_{AC}$ may be improved to a certain degree. However, because the capacitor C1 has the short life and should tolerate a high voltage, the cost of the capacitor C1 may be increased and it is difficult to reduce the size of a product due to the size of the capacitor C1.

Also, because the charging-discharging current of the capacitor C1 flows only in the second light-emitting diode part Db, which corresponds to the half of the used light-emitting diodes, to reduce the total harmonic distortion, the current flowing in the second light-emitting diode part Db increases and is higher than the current flowing in the first light-emitting diode part Da. When a current is maximally provided to the first light-emitting diode part Da, an overcurrent flows in the second light-emitting diode part Db. Therefore, a current that is enough to drive the first and second light-emitting diode parts Da and Db may not be provided to the light-emitting diode driving circuit.

Consequently, a maximum allowable current may not flow in the first and second light-emitting diode parts Da and Db, thus, the amount of emitted light is reduced.

Also, if the power voltage $V_{AC}$ increases due to the variation of the voltage, the magnitude of the current flowing in the first and second light-emitting diode parts Da and Db becomes greater than the maximum allowable current. Therefore, in consideration of the variation of the power voltage $V_{AC}$, the current flowing in the light-emitting diode may not reach the maximum allowable current, thus the amount of the emitted light is reduced.

SUMMARY

An object of the present disclosure is to drive a light-emitting diode even when a voltage is equal to or less than a forward threshold voltage, so as to reduce total harmonic distortion and increase the amount of emitted light.

An apparatus for driving a light-emitting diode according to one embodiment of the present disclosure is an apparatus for driving a first light-emitting diode part and a second light-emitting diode part connected in series, the first light-emitting diode part comprising one or more light-emitting diodes connected in series, the second light-emitting diode part being connected to the first light-emitting diode part and comprising one or more light-emitting diodes, the apparatus comprising: a rectification part, connected to the first light-emitting diode part, for rectifying AC power; a constant-current part, connected between the rectification part and the first light-emitting diode part, for outputting a current of a preset magnitude regardless of a rectified voltage output from the rectification part; a first resistor, connected between the first light-emitting diode part and the second light-emitting diode part, for detecting a current that flows through the first light-emitting diode part; a back-current prevention part, connected between the first light-emitting diode part and the first resistor, for preventing a back-current; a second resistor, connected between the second light-emitting diode part and a ground, for detecting a current that flows through the second light-emitting diode part; a first light-emitting diode auxiliary drive part, connected to the first resistor, for controlling light emission of the second light-emitting diode part depending on the current detected by the first resistor; and a second light-emitting diode auxiliary drive part, connected to the second resistor, for controlling light emission of the first light-emitting diode part depending on the current detected by the second resistor.

In this case, the first light-emitting diode auxiliary drive part comprises: a first transistor having an input terminal connected to an input terminal of the first light-emitting diode part, an output terminal, and a control terminal, the output terminal and the control terminal being connected to each other; a second transistor having an input terminal connected to an output terminal of the first transistor, and an output terminal connected between a second terminal of the first resistor and the second light-emitting diode part; and a third transistor having an input terminal connected to the input terminal of the first light-emitting diode part, a control terminal connected to the output terminal of the first transistor, and an output terminal connected to both a control terminal of the second transistor and a first terminal of the first resistor. The second light-emitting diode auxiliary drive part comprises: a first transistor having an input terminal connected to an output terminal of the first light-emitting diode part, an output terminal, and a control terminal, the output terminal and the control terminal being connected to each other; a second transistor having an input terminal connected to an output terminal of the first transistor, and an output terminal that is grounded; and a third transistor having an input terminal connected to the output terminal of the first light-emitting diode part, a control terminal connected to the output terminal of the first transistor, and an output terminal connected to both a control terminal of the second transistor and a first terminal of the second resistor.

In the apparatus for driving a light-emitting diodes according to the above characteristics, a plurality of light-emitting diode drive units may be connected in series between the constant-current part and the ground, each of the plurality of light-emitting diode drive units comprising the first and second light-emitting diode parts, the first and second resistors, the first and second light-emitting diode auxiliary drive parts, and the back-current prevention part.

The constant-current part is connected to the rectification part in series, and may have a plurality of constant-current units that have an identical structure, and each of the plurality of constant-current units may include a constant-current circuit for outputting a current of a preset magnitude, and a resistor, connected to the constant-current circuit, for outputting a current having a magnitude that is proportional to the rectified voltage output from the rectification part.

The constant-current circuit comprises: a first transistor having an input terminal connected to both an output terminal of the rectification part and a first terminal of the resistor, an output terminal, and a control terminal, the output terminal and the control terminal being connected to each other; a second transistor having an input terminal connected to the output terminal of the first transistor, and an output terminal connected to an outside, a third transistor having an input terminal connected to the output terminal of the rectification part, a control terminal connected to the output terminal of the first transistor, and an output terminal connected to both a control terminal of the second transistor and a second terminal of the resistor, and a resistor having a first terminal connected to the output terminal of the third transistor, and a second terminal connected to an output terminal of the constant-current circuit. The resistor connected to the constant-current circuit has a first terminal that is connected to the input terminals of the first and second transistors, and a second terminal that is connected to the output terminal of the third transistor.

An apparatus for driving a light-emitting diode according to another embodiment of the present disclosure is an apparatus for driving one or more light-emitting diodes, the apparatus comprising: a rectification part for outputting a rectified voltage; and a constant-current part, connected between the rectification part and the one or more light-emitting diodes. The constant-current part comprises a plurality of constant-current units, which are connected to the rectification part in series and have an identical structure. Each of the plurality of constant-current units comprises: a constant-current circuit, to which the rectified voltage is applied, for outputting a constant current; and a resistor, connected to the constant-current circuit, for outputting a current having a magnitude that is proportional to the rectified voltage. A current flows by being distributed to the constant-current circuit and the resistor until the rectified voltage reaches a preset voltage, and the current flows only through the resistor when the rectified voltage is equal to or greater than the preset voltage.

The constant-current circuit comprises: a first transistor having an input terminal connected to both an output terminal of the constant-current part and a first terminal of the resistor, an output terminal, and a control terminal, the output terminal and the control terminal being connected to each other; a second transistor having an input terminal connected to the output terminal of the first transistor, and an output terminal connected to an outside; a third transistor having an input terminal connected to the output terminal of the constant-current part, a control terminal connected to the output terminal of the first transistor, and an output terminal connected to both a control terminal of the second transistor and a second terminal of the resistor, and a resistor having a first terminal connected to the output terminal of the third transistor, and a second terminal connected to an output terminal of the constant-current circuit. The resistor connected to the constant-current circuit may comprise a first terminal that is connected to the input terminals of the first and second transistors, and a second terminal that is connected to the output terminal of the third transistor.

The first transistor may be a junction field effect transistor, and the second and third transistors may be npn bipolar transistors.

According to the above-mentioned characteristics, a current switch is implemented, which enables a current to flow in all light-emitting diodes even when a voltage is equal to or less than a threshold voltage by detecting a current flowing in the light-emitting diodes when AC power is applied. Actuation time of the light-emitting diodes increases, thus total harmonic distortion is decreased and light emission is improved.

Also, the amount of emitted light is increased, and an overcurrent caused from the variation of a voltage is prevented. As a result, the reliability of the lighting device is very high, and improved total harmonic distortion may be obtained.

Additionally, by a plurality of series-connected light-emitting diode drive units, an overvoltage is more effectively prevented.

Also, because a constant-current part has a plurality of constant-current units and distributes a voltage and power to the units, the operation of the constant-current part is stable, and the life of the constant-current part is extended.

DETAILED DESCRIPTION

Figure 1:
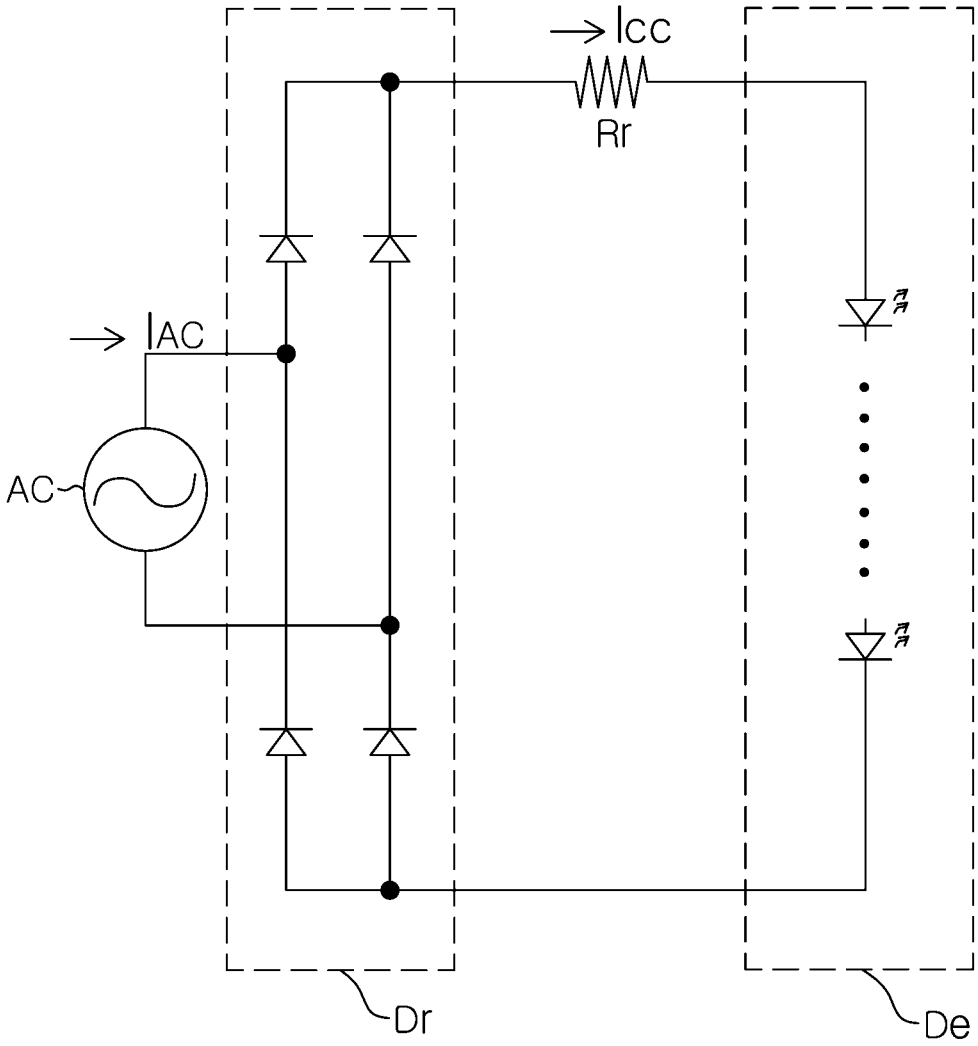
FIG. 1 is a circuit diagram of an example of a light-emitting diode driving circuit for an AC power operation according to convention.
Figure 2:
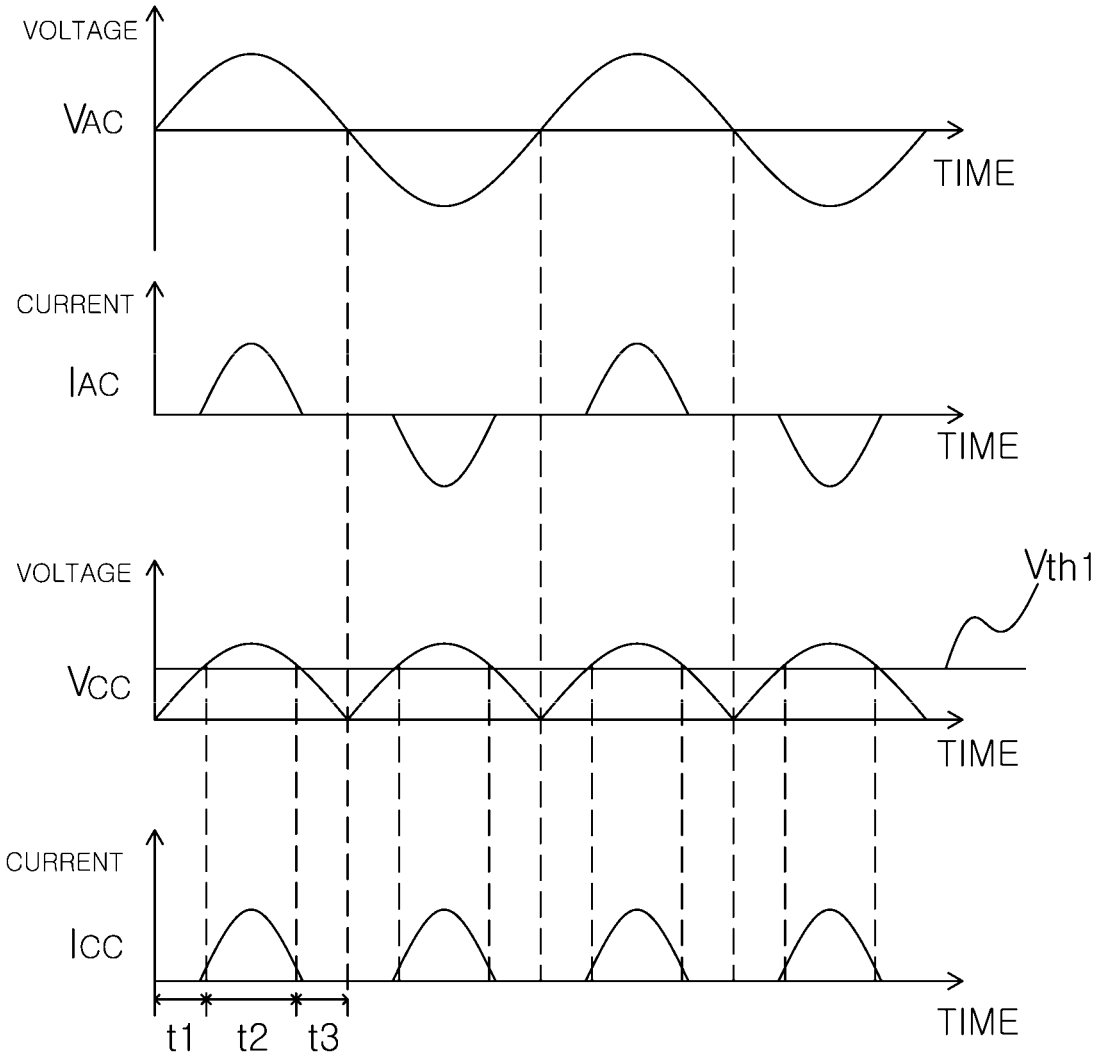
FIG. 2 is a view illustrating the waveforms of AC power, an AC current, a rectified voltage, and a rectified current of FIG. 1.
Figure 3:
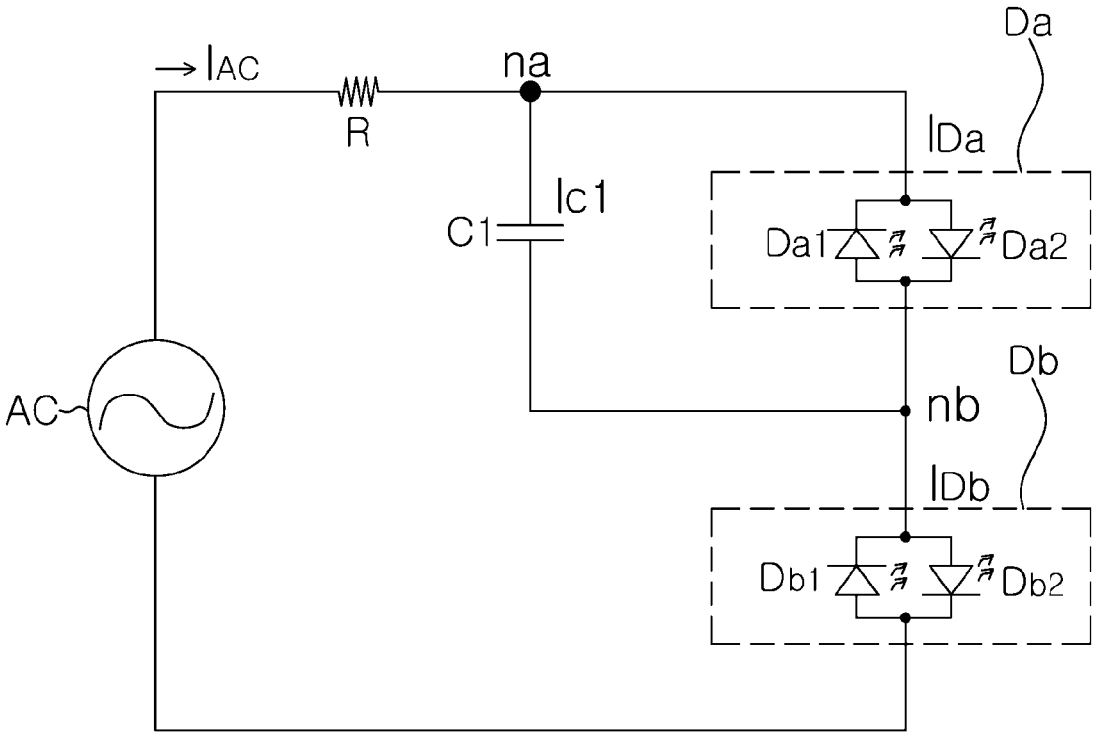
FIG. 3 is a circuit diagram of another example of a light-emitting diode driving circuit for an AC power operation according to convention.
Figure 4:
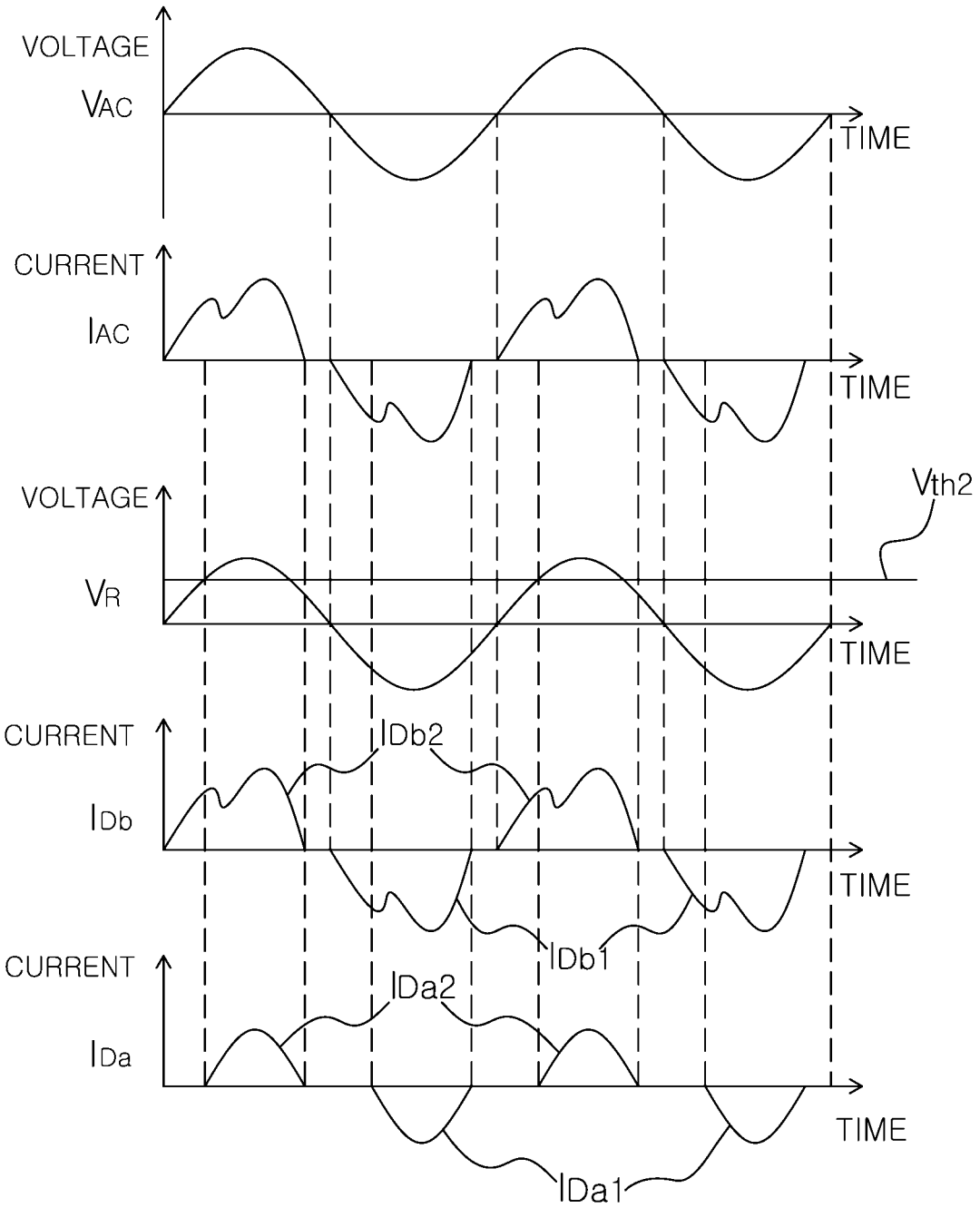
FIG. 4 is a view illustrating the waveforms of AC power, an AC current, a rectified voltage, and a rectified current of FIG. 3.

Hereinafter, exemplary embodiments of the present disclosure will be described in detail with reference to accompanying drawings, in order to enable those of ordinary skill in the art to embody and practice the disclosure. However, the present disclosure is not limited to the exemplary embodiments disclosed below, but can be implemented in various forms. To prevent the present disclosure from becoming vague in the description thereof, a detailed description of structures and/or devices known to the public shall be omitted, and same reference numerals are used throughout the different drawings to designate the same or similar components Hereinafter, referring to the accompanying drawings, an apparatus for driving a light-emitting diode, according to an embodiment of the present disclosure is described.

First, an apparatus for driving a light-emitting diode according to an embodiment of the present disclosure is described in detail with reference to FIG. 5.

Figure 5:
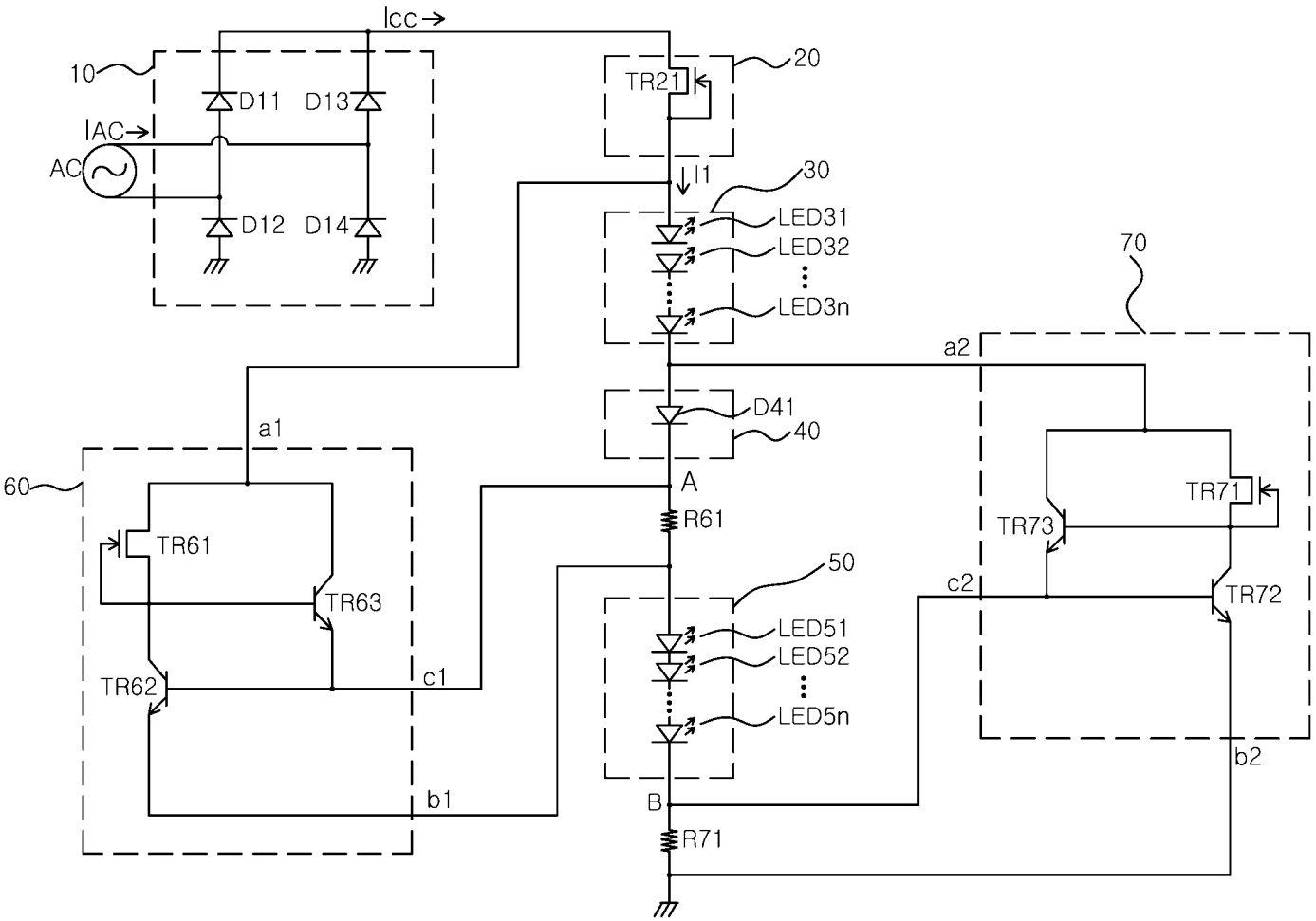
FIG. 5 is a circuit diagram of an apparatus for driving a light-emitting diode according to an embodiment of the present disclosure.

Referring to FIG. 5, the apparatus for driving a light-emitting diode according to an embodiment comprises a rectification part 10 connected to an AC power source, a constant-current part 20 connected to the rectification part 10, a first light-emitting diode part 30 connected to the constant-current part 20, a back-current prevention part 40 connected to the first light-emitting diode part 30, a resistor R61 (first resistor) connected to the back-current prevention part 40, a second light-emitting diode part 50 connected to the resistor R61, a resistor R71 (second resistor) connected between the second light-emitting diode part 50 and a ground, a first light-emitting diode auxiliary drive part 60 (hereinafter, referred to 'first LED auxiliary drive part') connected to the output terminal of the constant-current part 20 and both end terminals of the resistor R61, and a second light-emitting diode auxiliary drive part 70 (hereinafter, referred to 'second LED auxiliary drive part') connected to the output terminal of the first light-emitting diode part 30 and the output terminal of the second light-emitting diode part 50.

The AC power source is an alternating current power source for supplying power to a home or an office.

The rectification part 10 comprises: a diode string comprising diodes D11 and D12, which are connected in series and grounded; and another diode string comprising diodes D13 and D14, which are connected in series and grounded, wherein the two diode strings are connected in parallel.

By the operation of the rectification part 10, the AC power is full-wave rectified, and the rectification part 10 outputs a rectified voltage $V_{CC}$ that is a full-wave rectified voltage.

The constant-current part 20 comprises a transistor TR21 having a drain terminal (or an input terminal) connected to the rectification part 10; a gate terminal (or a control terminal); and a source terminal corresponding to an output terminal, the gate terminal and the source terminal being connected to each other. However, not limited to the above description, a constant-current part having another structure may be used.

In this embodiment, the transistor TR21 comprises a junction field effect transistor (JFET).

The constant-current part 20 outputs a preset current, which is a current of a certain magnitude that does not exceed a predefined magnitude, even when the rectified voltage $V_{CC}$ increases and is equal to or greater than a preset voltage. In other words, the constant-current part provides the preset current regardless of the variation of the rectified voltage $V_{CC}$. A light-emitting period within one cycle of the power may be increased, and a current that reaches a maximum current allowed in the first and second light-emitting diode parts 30 and 50 may be provided.

Therefore, an overcurrent that may be caused by the variation of the power voltage $V_{AC}$ is not applied to the first and second light-emitting diode parts 30 and 50. As a result, the life of a lighting device having the first and second light-emitting diode parts 30 and 50 is extended and light emission of the device is improved.

The first light-emitting diode part 30 has one or more light-emitting diodes LED31 to LED3*n*, which are forward series-connected between the output terminal of the constant-current part 20 and the back-current prevention part 40, and the second light-emitting diode part 50 has one or more light-emitting diodes LED51 to LED5*n*, which are forward series-connected between the resistor R61 and the resistor R71.

Each of the light-emitting diodes LED31 to LED3*n* and LED51 to LED5*n* emits light when a current flows in the light-emitting diode by applying a voltage that is equal to or greater than its threshold voltage.

The back-current prevention part 40 has a diode D41 that is forward connected between the first light-emitting diode part 30 and the resistor R61.

The diode D41 electrically separates the first light-emitting diode part 30 from the second light-emitting diode part 50, and prevents a back-current that flows from the resistor R61 to the first light-emitting diode part 30.

The first terminal of the resistor R61 is connected with the cathode terminal of the diode D41 and the first LED auxiliary drive part 60, and the second terminal thereof is connected with the input terminal of the second light-emitting diode part 50. The first terminal of the resistor R71 is connected with the second LED auxiliary drive part 70, and the second terminal thereof is grounded.

These resistors R61 and R71 detect the magnitude of the voltages that are respectively applied to the first and second light-emitting diode parts 30 and 50, using the currents flowing in the first and second light-emitting diode parts 30 and 50, and control the operations of the first and second LED auxiliary drive parts 60 and 70. Therefore, the resistors R61 and R71 serve as current detecting resistors.

In other words, when a voltage equal to or greater than a forward threshold voltage Vth3 is applied to the first and second light-emitting diode parts 30 and 50 and a preset current flows in the resistors R61 and R71, the operations of the first and second LED auxiliary drive parts 60 and 70 are blocked.

Conversely, when a voltage less than the forward threshold voltage Vth3 is applied to the first and second light-emitting diode parts 30 and 50 and a preset current does not flow in the resistors R61 and R71, the first and second LED auxiliary driver parts 60 and 70 are operated by a voltage applied thereto.

In this example, the forward threshold voltage Vth3 is the sum of the threshold voltages of the light-emitting diodes LED31 to LED3*n* and LED51 to LED5*n* that are included in the first and second light-emitting diode parts 30 and 50.

Therefore, by the operations of the resistors R61 and R71 and the operations of the first and second LED auxiliary drive parts 60 and 70, the first and second light-emitting diode parts 30 and 50 operate and emit light not only when the rectified voltage $V_{CC}$ output from the rectification part 10 is equal to or greater than the forward threshold voltage Vth3 but also when the rectified voltage is less than the forward threshold voltage Vth3.

For example, when the number of diodes LED31 to LED3*n* included in the first light-emitting diode part 30 is identical to the number of diodes LED51 to LED5*n* included in the second light-emitting diode part 50, the first and second light-emitting diode parts 30 and 50 each operate and emit light even in a section in which the rectified voltage is less than the forward threshold voltage Vth3 and is equal to or greater than ½ of the forward threshold voltage (Vth3/2).

As a result, the light emitting time of the first and second light-emitting diode parts 30 and 50 is increased. Light emission and total harmonic distortion are improved and a power factor is also improved.

The first and second LED auxiliary drive parts 60 and 70 have the same components and the same connection structures between the components.

The first LED auxiliary drive part has an input terminal a1, a control terminal b1, and an output terminal c1, and the second LED auxiliary drive part also has an input terminal a2, a control terminal b2, and an output terminal c2.

The first LED auxiliary drive part 60 comprises: a first transistor TR61 having a drain terminal connected to the input terminal of the first light-emitting diode part 30, namely, connected between the constant-current part 20 and the first light-emitting diode part 30, a source terminal, and a gate terminal, the source terminal and the gate terminal being connected to each other; a second transistor TR62 having a collector terminal (or input terminal) connected to the source terminal of the first transistor TR61, and an emitter terminal (or output terminal) connected to the second terminal of the resistor R61; and a third transistor TR63 having a collector terminal connected to the output terminal of the constant-current part 20, a base terminal (or control terminal) connected to the source terminal of the first transistor TR61, and an emitter terminal connected to both the base terminal of the second transistor TR6 and the first terminal of the resistor R61.

In this case, the drain terminal of the transistor TR61 and the collector terminal of the transistor TR63, which are connected to each other, form the input terminal a1 of the first LED auxiliary drive part 60; the base terminal of the transistor TR62 and the emitter terminal of the transistor TR63, which are commonly connected to the first terminal of the first resistor R61, form the control terminal c1 of the first LED auxiliary drive part 60; and the emitter terminal of the transistor TR62, which is connected to the second terminal of the resistor R61, forms the output terminal b1 of the first LED auxiliary drive part 60.

The first transistor TR61 is a JFET, and the second and third transistors TR62 and TR63 are npn bipolar transistors.

As described above, because the structure of the second LED auxiliary drive part 70 is identical to that of the first LED auxiliary drive part 60, the second LED auxiliary drive part 70 has a first transistor TR71, which is a JFET, and second and third transistors TR72 and TR73, which are npn bipolar transistors.

However, unlike the first LED auxiliary drive part 60, the drain terminal of the first transistor TR71 and the collector terminal of the third transistor TR73 are connected to the output terminal of the first light-emitting diode part 30, namely, connected between the first light-emitting diode part 30 and the diode D41; and the base terminal of the second transistor TR72 and the emitter terminal of the third transistor TR73 are connected to the output terminal of the second light-emitting diode part 50, namely, connected to the first terminal of the resistor R71.

Also, the emitter terminal of the second transistor TR72 is grounded.

In this case, the drain terminal of the transistor TR71 and the collector terminal of the transistor TR73, which are connected to each other, form the input terminal a2 of the second LED auxiliary drive part 70; the base terminal of the transistor TR72 and the emitter terminal of the transistor TR73, which are commonly connected to the first terminal of the second resistor R71, form the control terminal c2 of the second LED auxiliary drive part 60; and the emitter terminal of the transistor TR72, which is connected to the second terminal of the second resistor R71, namely, connected to a ground, forms the output terminal b2 of the second LED auxiliary drive part 70.

Currents flowing in the first and second light-emitting diode parts 30 and 50 are detected at corresponding points A and B by the resistors R61 and R71, and depending on the magnitude of the detected current, the operations of the transistors TR62 and TR72 are controlled. As a result, the operations of the first and second LED auxiliary drive parts 60 and 70 are controlled.

In this case, the LED auxiliary drive parts 60 and 70, and the resistors R61 and R71, which are respectively connected to the LED auxiliary drive parts, serve as a constant-current circuit for outputting a current of a constant magnitude, and the magnitude of the current for controlling the operations of the second transistors TR62 and TR72 can be controlled by adjusting the resistance values of the resistors R61 and R71.

Therefore, when the rectified voltage $V_{CC}$ of the rectification part 10 is equal to or greater than the forward threshold voltage Vth3, the second transistors TR62 and TR72 of the first and second LED auxiliary drive parts 60 and 70 are turned on, and when the rectified voltage $V_{CC}$ of the rectification part 10 is equal to or greater than the half of the forward threshold voltage Vth3 and less than the forward threshold voltage Vth3, a current flows through the third transistors TR63 and TR73 and the resistors R61 and R71.

Consequently, when the rectified voltage $V_{CC}$ is equal to or greater than the half of the forward threshold voltage (Vth3/2) and less than the forward threshold voltage Vth3, a current flows through the first LED auxiliary drive part 60—the resistor R61—the second light-emitting diode part 50—the resistor R71, thus the second light-emitting diode part 50 is lit. Also, a current flows through the first light-emitting diode part 30—the second LED auxiliary drive part—the resistor R71, and as a result, the first light-emitting diode part 30 is lit.

In this case, the magnitude of the current that flows respectively through the second and third constant-current parts 60 and 70 is I1/2, which corresponds to ½ of the current I1 that is output through the constant-current part 20.

The operation of a light-emitting diode driving apparatus having the above-mentioned structure will now be described in detail.

Figure 6:
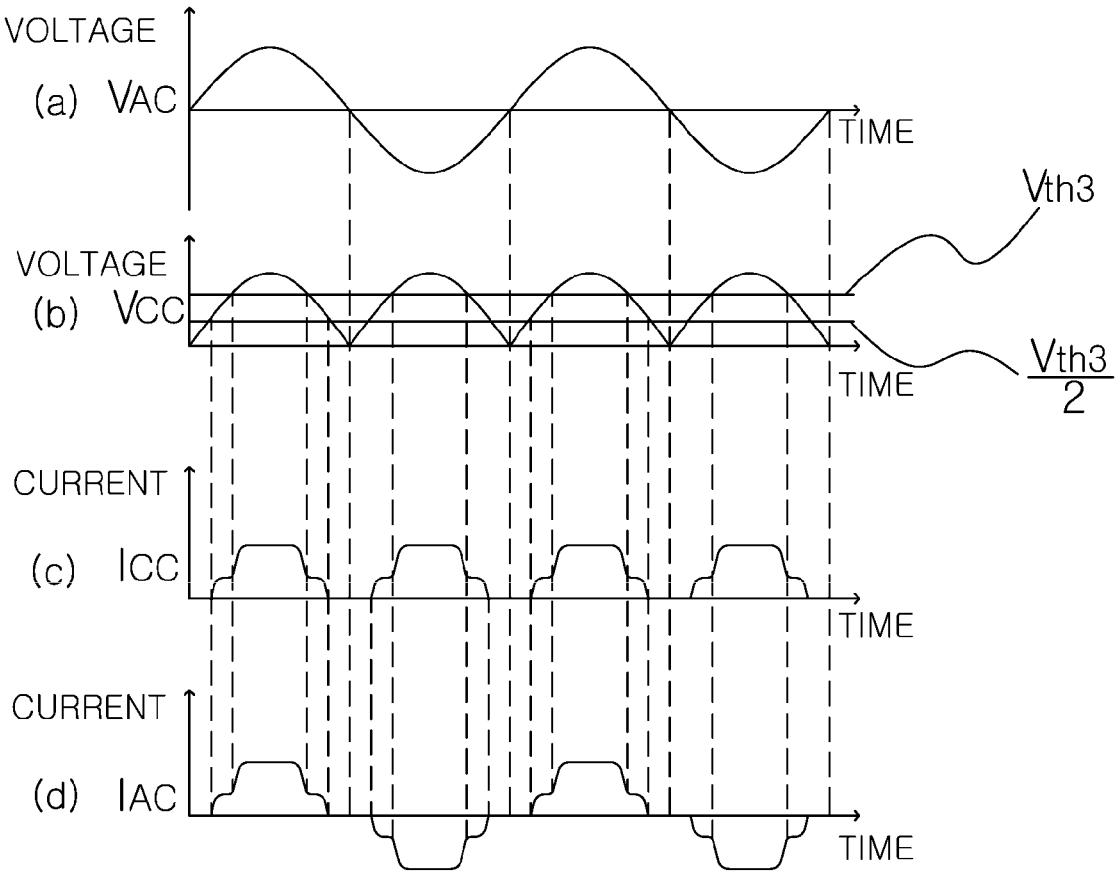
FIG. 6 is a view illustrating the waveforms of AC power, an AC current, a rectified voltage, and a rectified current of FIG. 5.

First, when the voltage $V_{AC}$ of the AC power source as shown in (a) of FIG. 6 is applied to the rectification part 10, the rectification part 10 full-wave rectifies the AC signal and converts the signal into a DC signal. The rectification part 10 outputs the rectified voltage $V_{CC}$ as shown in (b) of FIG. 6.

This rectified voltage $V_{CC}$ is applied to the constant-current part 20, and the constant-current part 20 outputs a current I1 of a corresponding magnitude. In this case, by the operation of the constant-current part 10, the magnitude of the current I1 that is output from the constant-current part 20 does not exceed a preset magnitude. An overcurrent that may be caused by the variation of the rectified voltage $V_{CC}$ does not occur, thus, the life of the light-emitting diode driving apparatus may be extended. Also, as a current reaching the maximum current, allowed by the first and second light-emitting diode parts 30 and 50, may be provided, light emission of the first and second light-emitting diode parts 30 and 50 is improved.

Next, when the magnitude of the rectified voltage $V_{CC}$ increases and reaches a preset voltage, which is a voltage required for lighting the first and second light-emitting diode parts 30 and 50, voltages that are necessary for lighting all the light-emitting diodes LED31 to LED3*n* and LED51 to LED5*n* in the light-emitting diode parts 30 and 50 are supplied. In this example, because the number of the light-emitting diodes LED31 to LED3*n* in the first light-emitting diode part 30 is identical to the number of the light-emitting diodes LED51 to LED5*n* in the second light-emitting diode part 50 and the operating characteristics of the first and second light-emitting diode parts 30 and 50 are identical, the driving voltage of each of the light-emitting diode parts 30 and 50 becomes a voltage corresponding to ½ of the forward threshold voltage (Vth3/2).

Under this condition (namely, when the rectified voltage $V_{CC}$ reaches the preset voltage (Vth3/2)), the third transistors TR63 and TR73 are turned on by the source voltage, which is a voltage of the source terminal of the first transistors TR61 and TR71 of the first and second LED auxiliary drive parts 60 and 70.

Accordingly, the half (I1/2) of the current I1 that is output from the constant-current part 20 flows through the third transistor TR63 of the first LED auxiliary drive part 60, which has been turned on, the resistor R61, the second light-emitting diode part 50, and the resistor R71. As a result, the second light-emitting diode part 50 is lit.

Also, the other half (I1/2) of the current I1 that is output from the constant-current part 20 also flows through the first light-emitting diode part 30, the third transistor TR73 of the second LED auxiliary drive part 70, and the resistor R71. As a result, the first light-emitting diode part 30 is also lit.

As described above, even when the magnitude of the rectified voltage $V_{CC}$ does not reach the forward threshold voltage Vth3, the first and second light-emitting diode parts 30 and 50 are driven in parallel by the operations of the first and second LED auxiliary drive parts 60 and 70, and are lit.

By the operations of the first and second LED auxiliary drive parts 60 and 70, the second and the first light-emitting diode parts 50 and 30 are operated, and as a result, when a current starts to flow to the resistors R61 and R71, the voltages, corresponding to the current flowing through the resistors R61 and R71, are respectively applied from contacts points A and B to the base terminals of the second transistors TR62 and TR72 of the first and second LED auxiliary drive parts 60 and 70.

When the rectified voltage $V_{CC}$ illustrated in (b) of FIG. 6 increases and reaches the forward threshold voltage Vth3, all the light-emitting diodes LED31 to LED3*n* and LED51 to LED5*n* of the first and second light-emitting diode parts 30 and 50, which are connected to the rectification part 10 in series, may be driven in series.

Therefore, the current I1 that is output from the constant-current part 20 flows sequentially through the first light-emitting diode part 30—the diode D41—the resistor R61—the second light-emitting diode part 50—the resistor R71, and flows to a ground.

As the first and second light-emitting diode parts 30 and 50 are driven in series, the magnitude of the current flowing in the first and second light-emitting diode parts 30 and 50 is increased to 'I1'.

Therefore, when the magnitude of a current flowing in the contact point A is equal to or greater than a preset magnitude (for example, I1) because the first and second light-emitting diode parts 30 and 50 are driven in series, the increased voltage corresponding to the magnitude (I1) of the current is applied to the base terminal of the second transistor TR62 of the first LED auxiliary drive part 60, and the second transistor TR62 is converted from a turn-off state to a turn-on state.

When the rectified voltage $V_{CC}$ increases and is equal to or greater than the forward threshold voltage Vth2, the current at the contact point A is equal to or greater than the preset current. When the second transistor TR62 of the first LED auxiliary drive part 60 is turned on, a portion of the current I1 output from the constant-current part 20 flows through the first and second transistors TR61 and TR62, the second light-emitting diode part 50, and the resistor R71, and flows to a ground. As a result, the third transistor TR63 that has maintained the turn-on state is converted to a turn-off state.

Like the first LED auxiliary drive part 60, when the magnitude of a current flowing in the contact point B is equal to or greater than the preset magnitude (I1) because the first and second light-emitting diode parts 30 and 50 are driven in series, the increased voltage corresponding to the magnitude of the current I1 is applied to the base terminal of the second transistor TR72 of the second LED auxiliary drive part 70, and the second transistor TR72 is converted from the turn-off state to a turn-on state.

Therefore, when the second transistor TR72 of the second LED auxiliary drive part 70 is turned on, a portion of the current I1 flows to a ground via the first and second transistors TR71 and TR72. As a result, the third transistor TR73 is converted into a turn-off state.

As described above, when the rectified voltage $V_{CC}$ is equal to or greater than the forward threshold voltage Vth3, the magnitude of the currents, respectively flowing in the contact points A and B, increases and becomes equal to or greater than a preset magnitude. As a result, the second transistors TR62 and TR72 of the first and second LED auxiliary drive parts 60 and 70 are turned on, and the third transistors TR63 and TR73 are turned off. The first and the second light-emitting diode parts 30 and 50 are lit by the series system by the forward threshold voltage Vth3, rather than the parallel system through the first and second LED auxiliary drive parts 60 and 70.

By the above-mentioned operations, the operating section of the first and the second light-emitting diode parts 30 and 50 during one cycle of the power voltage $V_{AC}$ corresponds to the section in which the rectified voltage $V_{CC}$ is equal to or greater than the half of the forward threshold voltage (Vth3/2). The lighting time of the first and second light-emitting diode parts 30 and 50 is increased and the amount of emitted light of the first and second light-emitting diode parts 30 and 50 is increased.

Figure 7:
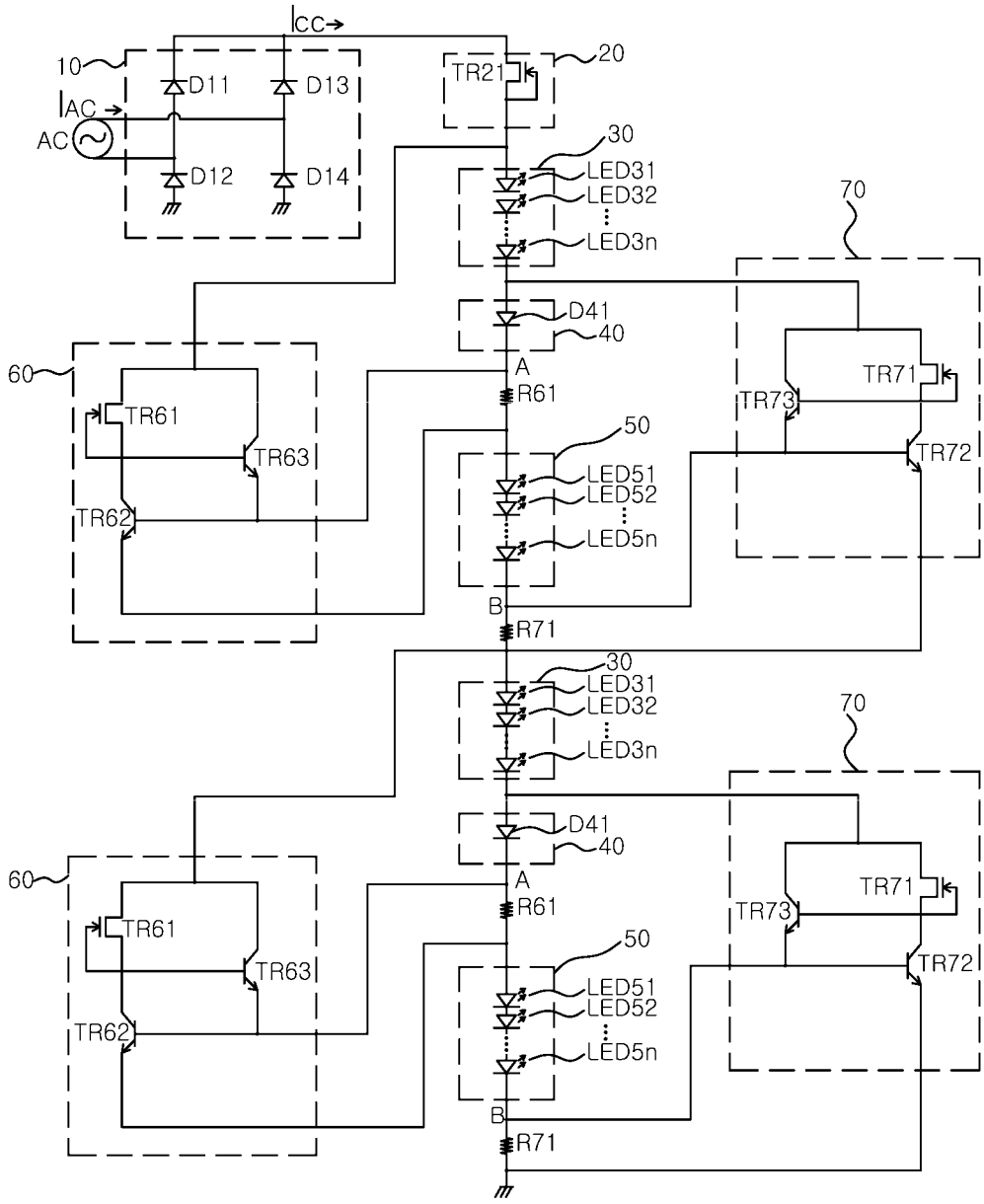
FIG. 7 is a circuit diagram of another example of an apparatus for driving a light-emitting diode according to an embodiment.

Next, referring to FIG. 7, another example of the apparatus for driving a light-emitting diode according to an embodiment of the present disclosure is described.

Compared to FIG. 5, the same reference numeral will be used to refer to a part implementing the same function, and the detailed description of the part will be omitted.

In FIG. 5, there is one light-emitting drive unit, which comprises the first and second light-emitting parts 30 and 50, the back-current prevention part 40, and the first and second LED auxiliary drive parts 60 and 70, between the constant-current part 20 and a ground. However, in FIG. 7, there are a plurality of light-emitting diode drive units, which are connected to each other in series, between the constant-current part 20 and a ground.

In FIG. 7, the total number of light-emitting diodes included in the plurality of light-emitting diode drive units is identical to the total number of the light-emitting diodes included in the single light-emitting diode drive unit, illustrated in FIG. 5, thus the forward threshold voltage Vth3 is the same as that of FIG. 5.

As shown in FIG. 7, when two light-emitting diode drive units exist, the number of the light-emitting diodes included in each of the four light-emitting diode parts 30 and 40 may be the half of the number of the light-emitting diodes included in each of the light-emitting diode parts 30 and 40 of FIG. 5.

Also, the current detecting resistors R61 and R71 in the same light-emitting diode drive unit may have an identical resistance value, whereas the current detecting resistors R61 and R71 included in the different light-emitting diode drive units may have different resistance values.

The operation of a light-emitting diode drive unit when a plurality of light-emitting diode drive units are connected in series will now be described.

Figure 8:
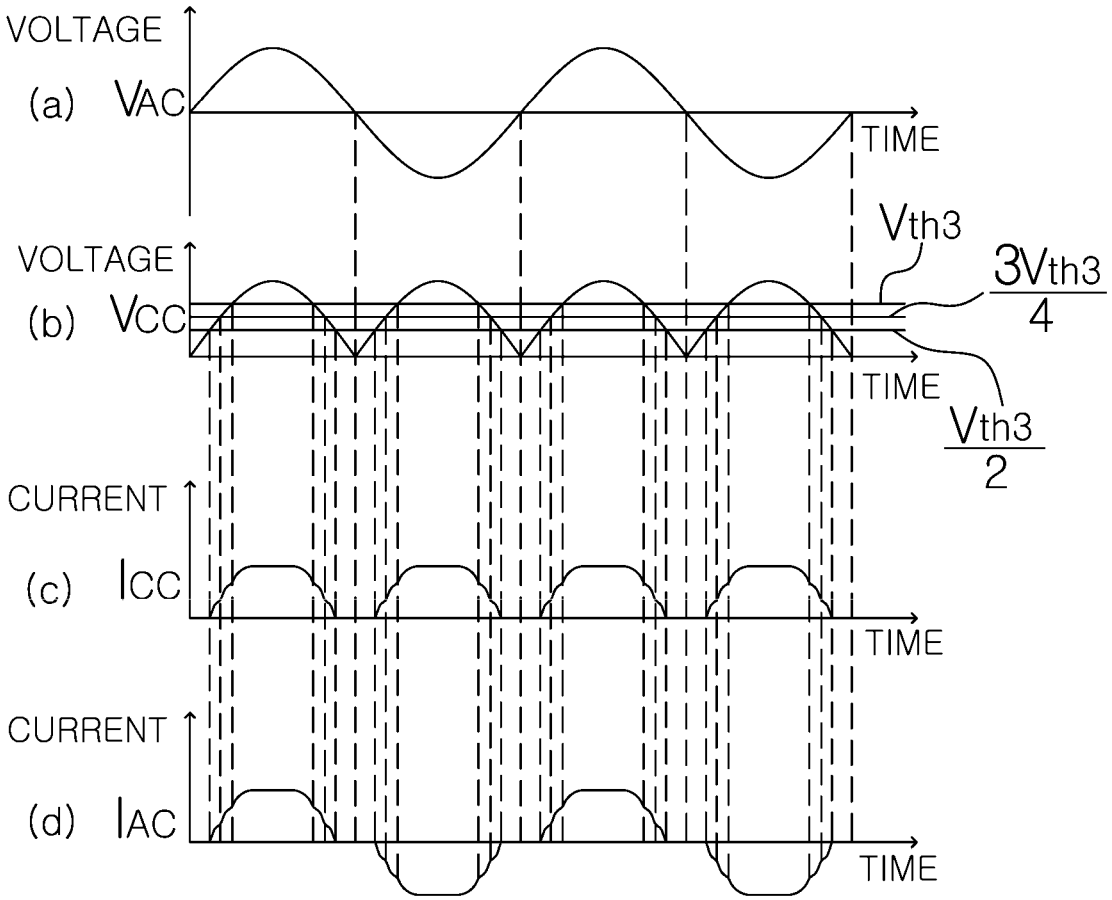
FIG. 8 is a view illustrating the waveforms of AC power, an AC current, a rectified voltage, and a rectified current of FIG. 7.

As one example, the operation of two light-emitting diode drive units, which are connected in series, is described with reference to FIG. 8.

In FIG. 7, a light-emitting diode drive unit that is connected to the constant-current part 20 and is located in the upper part of the light-emitting diode driving apparatus is referred to a first light-emitting diode drive unit, and a light-emitting diode drive unit that is connected to the first light-emitting diode drive unit and is located in the lower part of the light-emitting diode driving apparatus is referred to a second light-emitting diode drive unit.

First, like FIG. 5, the apparatus for driving a light-emitting diode illustrated in FIG. 7 is lit by the operations of the four light-emitting diode parts 30 and 50 each not only when the rectified voltage $V_{CC}$ is equal to or greater than the forward threshold voltage Vth3 but also when the rectified voltage $V_{CC}$ is less than the forward threshold voltage Vth3 and is equal to or greater than the half of the forward threshold voltage (Vth3/2).

In this case, the operation of the light-emitting diode drive unit is different depending on the magnitude of the rectified voltage $V_{CC}$.

In other words, when the magnitude of the rectified voltage $V_{CC}$ is equal to or greater than ½ of the forward threshold voltage (Vth3/2) and less than ¾ of the forward threshold voltage (3Vth3/4), the rectified current $I_{cc}$ flows through the constant-current part 20—the first LED auxiliary drive part 60 of the first light-emitting diode drive unit—the second light-emitting diode part 50 of the first light-emitting diode drive unit—the resistor R71 of the first light-emitting diode drive unit—the first LED auxiliary drive part 60 of the second light-emitting diode drive unit—the second light-emitting diode part 50 of the second light-emitting diode drive unit—the resistor R71 of the second light-emitting diode drive unit, in order to light the two second light-emitting diode parts 50 included in the first and second light-emitting diode drive units.

Similarly, when the magnitude of the rectified voltage $V_{CC}$ is equal to or greater than ½ of the forward threshold voltage (Vth3/2) and less than ¾ of the forward threshold voltage (3Vth3/4), the rectified current $I_{cc}$ flows through the constant-current part 20—the first light-emitting diode part 30—the second LED auxiliary drive part 70 of the first light-emitting diode drive unit—the first light-emitting diode part 30 of the second light-emitting diode drive unit—the second LED auxiliary drive part 70 of the second light-emitting diode drive unit, in order to light the two first light-emitting diode parts 30 included in the first and second light-emitting diode drive units.

As mentioned above, when the magnitude of the rectified voltage $V_{CC}$ is equal to or greater than ½ of the forward threshold voltage (Vth3/2) and less than ¾ of the forward threshold voltage (3Vth3/4), all of the first and second LED auxiliary drive units 60 and 70 included in the first and second light-emitting diode drive units operate, and the first and second light-emitting diode parts 30 and 50 disposed in the first and second light-emitting diode drive units are lit.

However, when the magnitude of the rectified voltage $V_{CC}$ is equal to or greater than ¾ of the forward threshold voltage (3Vth3/4) and less than the forward threshold voltage, only the first and second LED auxiliary drive parts 60 and 70 included in any one of the first and second light-emitting diode drive units operate, and four light-emitting diode parts 30 and 50 disposed in the first and the second light-emitting diode drive units are lit.

In this case, the light-emitting diode drive unit to be operated is selected depending on the resistance of the resistors R61 and R71 included in the first and second light-emitting diode drive units.

As one example, when the second light-emitting diode drive unit operates, the rectified current $I_{CC}$ passes through the first and second light-emitting diode parts 30 and 50 of the first light-emitting diode drive unit, and flows through the first LED auxiliary drive part 60 and the second light-emitting diode part 50 of the second light-emitting diode drive unit, and also flows through the first light-emitting diode part 30 and the second LED auxiliary drive part 70 of the second light-emitting diode drive unit.

However, when the magnitude of the rectified voltage $V_{CC}$ is equal to or greater than the forward threshold voltage Vth3, the rectified current $I_{CC}$ flows through the light-emitting diode parts 30 and 50, which are connected in series, and the four light-emitting diode parts 30 and 50 are lit. In this case, the operations of the first and second LED auxiliary drive parts 60 and 70 of the each of the light-emitting diode drive units are blocked by the current that is applied to the first and second LED auxiliary drive parts 60 and 70 of each of the light-emitting diode drive units through the current detecting resistors R61 and R71.

Under the condition that the plurality of light-emitting diode drive units are connected in series, when the light-emitting diode parts 30 and 50 are driven, the lighting time of the first and the second light-emitting diode parts 30 and 50 during one cycle of the power voltage $V_{AC}$ is increased as described with reference to FIG. 5, thus the amount of emitted light of the first and second light-emitting diode parts 30 and 50 is increased.

Additionally, as the first and the second light-emitting diode parts 30 and 50 are lit, the variation of the current lessens and the life of the light-emitting diode driving apparatus is increased. Also, because of the plurality of light-emitting diode drive units that are connected in series, the driving voltage AC may be distributed, thus the effect of preventing an overcurrent may be improved.

Figure 9:
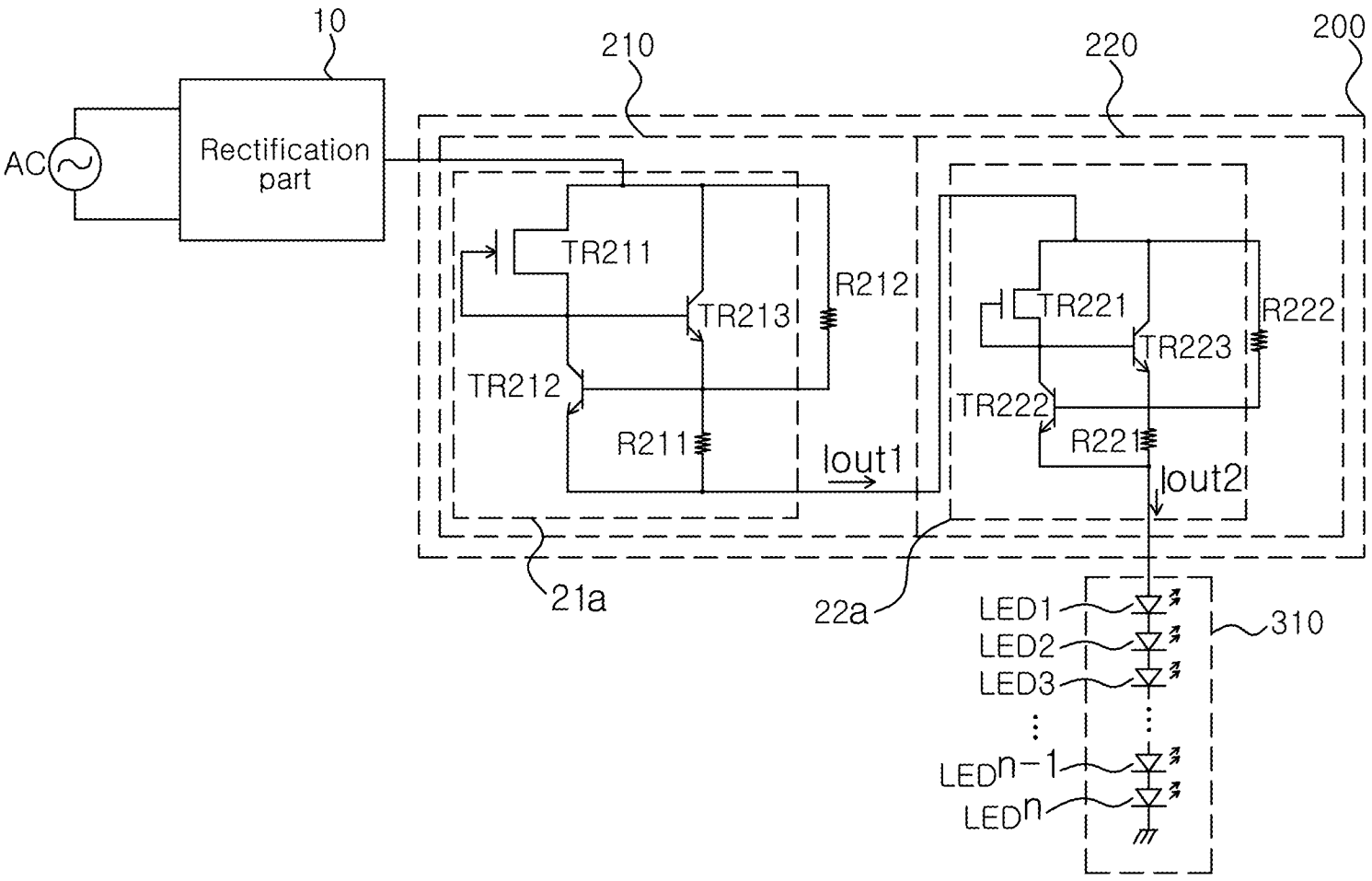
FIG. 9 is a circuit diagram of an apparatus for driving a light-emitting diode according to another embodiment.

Next, referring to FIG. 9, an apparatus for driving a light-emitting diode according to another embodiment is described.

As illustrated in FIG. 9, the apparatus for driving a light-emitting diode according to this embodiment comprises an AC power source, a rectification part 10 connected to the AC power source, a constant-current part 200 connected to the rectification part 10, and a light-emitting diode part 310 that is connected between the constant-current part 200 and a ground and that comprises a plurality of light-emitting diodes LED1 to LEDn.

The rectification part 10 is a full-wave rectifier, which is the same as the rectification part illustrated in FIG. 5.

In this example, the constant-current part 200 has first and second constant-current units 210 and 220, which are connected in series between the rectification part 10 and the light-emitting diode part 310.

In this case, the first and second constant-current units 210 and 220 have the same structure excluding a connection structure of an input terminal and an output terminal. Also, in this example, two constant-current units 210 and 220 are included in the constant-current part 200, but two or more units may be included according to need.

Each of the first and second constant-current units 210 and 220 comprises: a constant-current circuit 21*a* or 22*a* for outputting a constant magnitude of current, which has a structure identical to that of the first and second LED auxiliary drive parts 60 and 70 and the resistors R61 and R71 respectively connected to the drive parts 60 and 70, in the light-emitting diode driving apparatus illustrated in FIG. 5; and a resistor R212 or 222 for outputting a current that is proportional to the applied voltage, which is connected to the constant-current circuit 21*a* or 22*a*.

Therefore, each of the first and second constant-current units 210 and 220 includes a constant-current circuit 21*a* or 22*a*, and a resistor R212 or R222. The constant-current circuit 21*a* or 22*a* comprises: a first transistor TR211 or TR221, which comprises a JFET, and of which the gate terminal and the source terminal are connected to each other; second and third transistors TR212 and TR213 or TR222 and TR223, which are connected to the first transistor TR211 or TR221 and comprise a bipolar transistor; and a resistor R211 or R211 connected to the third transistor TR213 or TR223. The resistor R212 or R222 is connected between the collector terminal and emitter terminal of the third transistor TR213 or TR223 of the constant-current circuit 21*a* or 22*a*.

However, unlike FIG. 5, in this example, the emitter terminal of the transistor TR212 and the second terminal of the resistor R211, which are connected to each other and correspond to the output terminal of the constant-current circuit 21*a* of the first constant-current unit 210, are connected to the drain terminal of the transistor TR221 and the collector terminal of the transistor TR223, which correspond to the input terminal of the second constant-current unit 210, and the emitter terminal of the transistor TR222 and the second terminal of the resistor R221, which correspond to the output terminal of the second constant-current unit 210, are connected to the input terminal of the light-emitting diode part 310.

As mentioned above, because the first and second constant-current circuits 21*a* and 22*a* have the same structure, the operation of the first constant-current circuit 21*a* is described with reference to FIG. 10.

When a rectified voltage $V_{CC}$ is applied to the input terminal of the first constant-current circuit 21*a*, namely, to the drain terminal of the first transistor TR211, the collector terminal of the transistor TR213, and the first terminal of the resistor R212, which are connected to each other, a current flows to the outside (for example, the second constant-current unit 220) via the transistor TR213 and the resistor R211, and also flows through the transistors TR211 and TR212.

In this case, when a voltage $V_{BE}$ applied between the base terminal and emitter terminal of the transistor TR212, namely, a voltage applied to both terminals of the resistor R211 is equal to or greater than a preset voltage (for example, 0.6 V), a current is output only through the transistors TR211 and TR212. The transistor TR213 is turned off, and a current flowing through the transistor TR213 is blocked.

In this structure, when the voltage $V_{BE}$ between the base terminal and emitter terminal of the transistor TR212 is equal to or greater than the preset voltage (for example, 0.6 V), the current $I_{R211}$ flowing in the resistor R211 is calculated to $I_{R211}$=0.6/R211.

Figure 10:
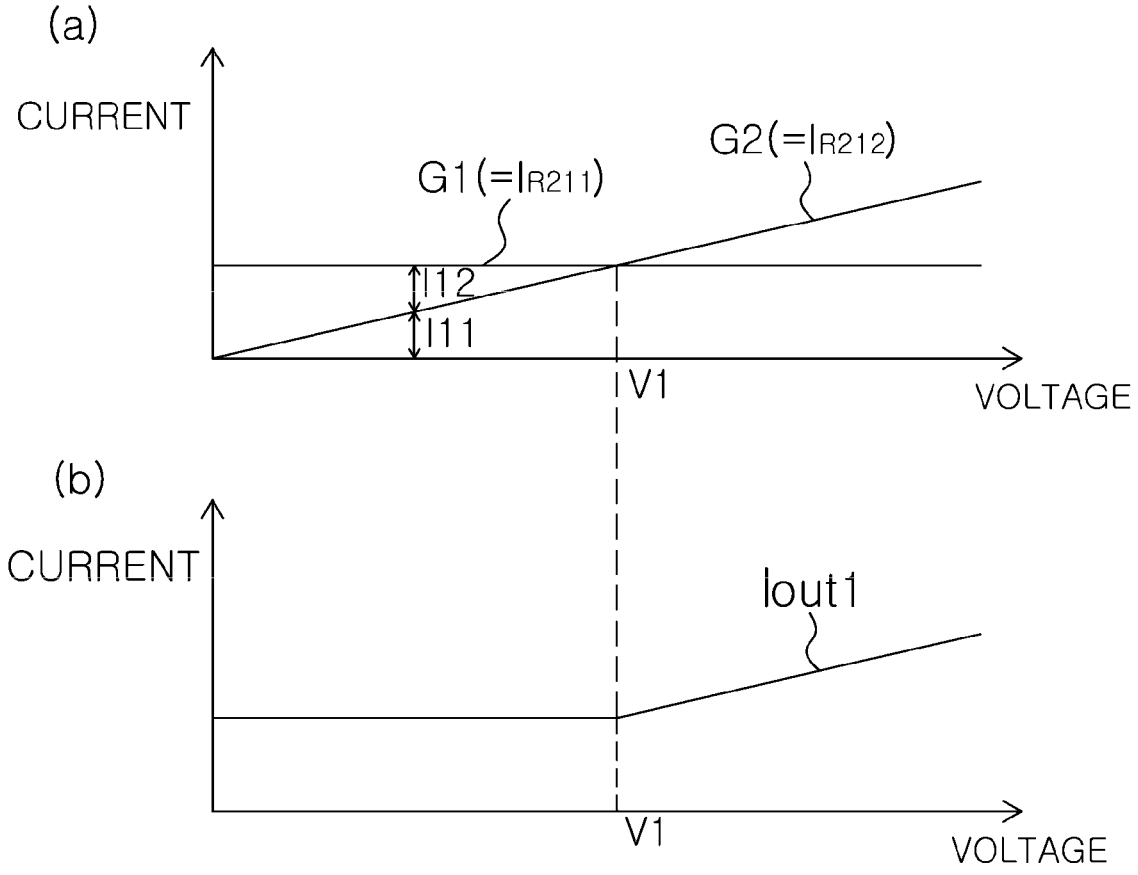
FIG. 10 is an operation waveform diagram of a constant-current unit of a light-emitting diode drive part, and specifically, (a) is a waveform diagram of a current that is output from a constant-current circuit and a resistor, and (b) is a waveform diagram of an output current that is output from the constant-current unit.

Therefore, because the magnitude of the current output from the constant-current circuit 21*a*, namely, the magnitude of the current flowing in the resistor R211 is determined depending on the magnitude of the resistance of the resistor R211, the transistors TR211 to TR213 and the resistor R211 form a constant-current circuit as described above, and in the constant-current circuit, the constant current $I_{R211}$ flows regardless of the magnitude of the voltage, like the graph G1 illustrated in (a) of FIG. 10.

However, the current $I_{R212}$ flowing through the resistor R212 that connected between the input terminal and control terminal of the constant-current circuit is proportional to the voltage, like the graph G2 illustrated in (a) of FIG. 10.

In the graph illustrated in (a) of FIG. 10, when the rectified voltage $V_{CC}$ that is applied to the input terminal of the constant-current circuit 21*a* is less than a preset voltage V1, the magnitude of the current $I_{R211}$ flowing through the resistor R212 becomes I11, and the current flowing through the transistor TR213 becomes I12. Therefore, until the rectified voltage reaches the first voltage V1, the current is distributed to the transistor TR213 and the resistor R212.

However, when the rectified voltage becomes the preset voltage V1 (for example, the voltage $V_{BE}$ between the base terminal and emitter terminal of the transistor TR212 becomes 0.6 V), the current does not flow through the transistor TR213, and the current flowing through the resistor R212 becomes the output current Iout1 of the constant-current unit 210.

In this case, a current flows through the transistors TR211 and TR212, but the magnitude of the current is much lower than the current flowing through the resistor R212. Therefore, the current flowing through the transistors TR211 and TR212 is ignored.

Consequently, when a voltage greater than the preset voltage V1 is applied to the constant-current unit 210, the output current Iout1 output from the constant-current unit 210 is the same as the current flowing through the resistor R212.

The operation when a plurality of constant-current units 210 having such a voltage-current characteristic (the first and second constant-current units 210 and 220) are connected in series as shown in FIG. 9, is described with reference to FIG. 11.

As already described with reference to FIG. 10, in (a) of FIG. 9, a voltage-current characteristic that is output from one of the first and second constant-current units 210 or 220 is represented as a graph G11, and a voltage-current characteristic that is output from the other of the first and second constant-current units 220 or 210 is represented as a graph G12.

Figure 11:
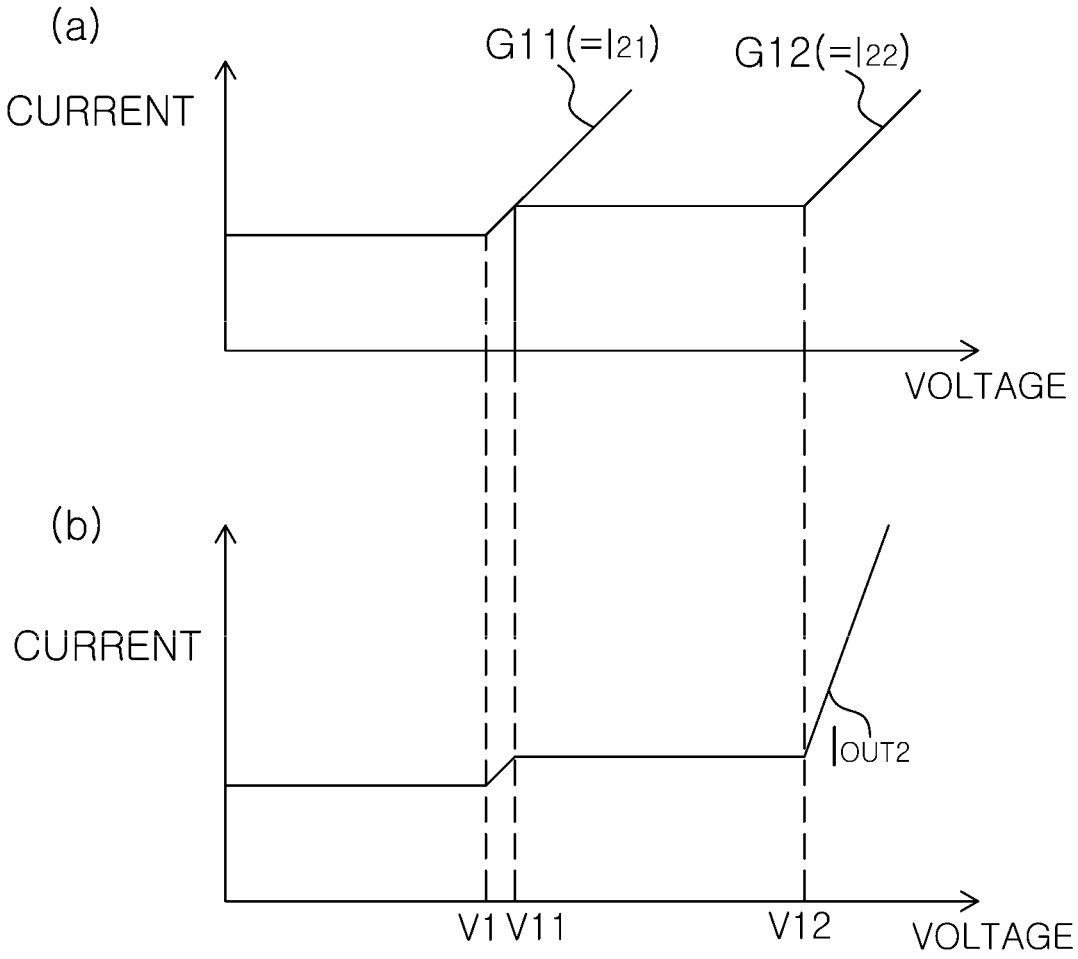
FIG. 11 is an operation waveform diagram of a constant-current unit of the light-emitting drive part of FIG. 9, and specifically, (a) is a waveform diagram of a current that is output from first and second constant-current units, and (b) is a waveform diagram of an output current that is output from a constant-current part.

In FIG. 11, until a rectified voltage $V_{CC}$ reaches a preset voltage V11 (namely, to the point at which currents I21 and I22, respectively output from the first and second constant-current units 210 and 220, meet on the graph), a current I21 flows only in the first operated unit of the constant-current part 200, in other words, in either the first constant-current unit 210 or the second constant-current unit 220. A voltage of the first operated constant-current unit 210 or 220 is increased, and a current I21 corresponding to the magnitude of the voltage is output as the output current Iout2.

However, when the rectified voltage is equal to or greater than the corresponding voltage V11, a current flows in the remaining constant-current unit 220 or 210. From this time, the voltage increases only in the remaining constant-current unit 220 or 210, and the current I22 corresponding to the increased voltage is output as the output current Iout2.

Then, after the voltage reaches a preset voltage V12, namely, after the current of the constant-current unit 220 or 210 that is operated later starts to increase due to the operation of the resistor R222 or R221, both of the first and second constant-current units 210 and 220 operate and output the current Iout2. In this case, the output current Iout2 is greater than the currents I21 and I22, respectively output from the first and second constant-current units 210 and 220.

Through this operation, the current Iout2 output from the constant-current part 200 has a value that is increased in stages depending on the magnitude of the rectified voltage $V_{CC}$.

When the rectified voltage $V_{CC}$ output from the rectification part 10 is equal to or greater than the forward threshold voltage, the light-emitting diode part 300 operates and maintains light emission.

As described above, in the case of the constant-current part 200 having a plurality of constant-current units 210 and 220, before any one constant-current unit 210 or 220 is damaged due to the increase of the voltage, the operation of the unit is switched to the operation of the other constant-current unit 220 or 210, by the operation of the resistors R212 and R22 of the plurality of constant-current units 210 and 220. The constant-current part outputs a current of a predefined magnitude and serves as a voltage distributor for distributing a voltage to the plurality of units.

Therefore, the constant-current units 210 and 220 are prevented from the damage that may be caused by the increase of the rectified voltage $V_{CC}$, thus the stability and the life of the constant-current part 200 are improved.

The above-mentioned constant-current part 200 may be applied to the constant-current part 20 illustrated in FIGS. 5 and 7.

Although the preferred embodiments have been disclosed for illustrative purposes, those skilled in the art will appreciate that various modifications, additions and substitutions are possible, without departing from the scope and spirit of the invention as disclosed in the accompanying claims.

The invention claimed is:

1. An apparatus for driving a first light-emitting diode part and a second light-emitting diode part connected in series, the first light-emitting diode part comprising one or more light-emitting diodes, the second light-emitting diode part being connected to the first light-emitting diode part and comprising one or more light-emitting diodes, the apparatus comprising:

a rectification part, connected to the first light-emitting diode part, for rectifying AC power;

a constant-current part, connected between the rectification part and the first light-emitting diode part, for outputting a current of a preset magnitude regardless of a rectified voltage output from the rectification part;

a first resistor, connected between the first light-emitting diode part and the second light-emitting diode part, for detecting a current that flows through the first light-emitting diode part;

a back-current prevention part, connected between the first light-emitting diode part and the first resistor, for preventing a back-current;

a second resistor, connected between the second light-emitting diode part and a ground, for detecting a current that flows through the second light-emitting diode part;

a first light-emitting diode auxiliary drive part, connected to the first resistor, for controlling light emission of the second light-emitting diode part depending on the current detected by the first resistor; and a second light-emitting diode auxiliary drive part, connected to the second resistor, for controlling light emission of the first light-emitting diode part depending on the current detected by the second resistor, wherein the first light-emitting diode auxiliary drive part comprises, a first transistor having an input terminal connected to an input terminal of the first light-emitting diode part, an output terminal, and a control terminal, the output terminal and the control terminal being connected to each other, a second transistor having an input terminal connected to an output terminal of the first transistor, and an output terminal connected between a second terminal of the first resistor and the second light-emitting diode part, and a third transistor having an input terminal connected to the input terminal of the first light-emitting diode part, a control terminal connected to the output terminal of the first transistor, and an output terminal connected to both a control terminal of the second transistor and a first terminal of the first resistor, and wherein the second light-emitting diode auxiliary drive part comprises, a first transistor having an input terminal connected to an output terminal of the first light-emitting diode part, an output terminal, and a control terminal, the output terminal and the control terminal being connected to each other;

a second transistor having an input terminal connected to an output terminal of the first transistor, and an output terminal that is grounded, and a third transistor having an input terminal connected to the output terminal of the first light-emitting diode part, a control terminal connected to the output terminal of the first transistor, and an output terminal connected to both a control terminal of the second transistor and a first terminal of the second resistor.

2. The apparatus of claim 1, wherein between the constant-current part and the ground, a plurality of light-emitting diode drive units are connected in series, each of the plurality of light-emitting diode drive units including the first and second light-emitting diode parts, the first and second resistors, the first and second light-emitting diode auxiliary drive parts, and the back-current prevention part.

3. The apparatus of claim 1, wherein the constant-current part is connected to the rectification part in series, and comprises a plurality of constant-current units that have an identical structure, and each of the plurality of constant-current units comprises a constant-current circuit for outputting a current of a preset magnitude, and a resistor, connected to the constant-current circuit, for outputting a current having a magnitude that is proportional to the rectified voltage output from the rectification part.

4. The apparatus of claim 3, wherein:

the constant-current circuit comprises, a first transistor having an input terminal connected to both an output terminal of the rectification part and a first terminal of the resistor, an output terminal, and a control terminal, the output terminal and the control terminal being connected to each other, a second transistor having an input terminal connected to the output terminal of the first transistor, and an output terminal connected to an outside, a third transistor having an input terminal connected to the output terminal of the rectification part, a control terminal connected to the output terminal of the first transistor, and an output terminal connected to both a control terminal of the second transistor and a second terminal of the resistor, and a resistor having a first terminal connected to the output terminal of the third transistor, and a second terminal connected to an output terminal of the constant-current circuit, wherein the resistor connected to the constant-current circuit has a first terminal that is connected to the input terminals of the first and second transistors, and a second terminal that is connected to the output terminal of the third transistor.

5. An apparatus for driving one or more light-emitting diodes, the apparatus comprising:

a rectification part for outputting a rectified voltage; and a constant-current part connected between the rectification part and the one or more light-emitting diodes, wherein:

the constant-current part comprises a plurality of constant-current units, which are connected to the rectification part in series and have an identical structure;

each of the plurality of constant-current units comprises, a constant-current circuit, to which the rectified voltage is applied, for outputting a constant current, and a resistor, connected to the constant-current circuit, for outputting a current having a magnitude that is proportional to the rectified voltage, and wherein a current flows by being distributed to the constant-current circuit and the resistor until the rectified voltage reaches a preset voltage, and the current flows only through the resistor when the rectified voltage is equal to or greater than the preset voltage.

6. The apparatus of claim 5, wherein:

the constant-current circuit comprises, a first transistor having an input terminal connected to both an output terminal of the constant-current part and a first terminal of the resistor, an output terminal, and a control terminal, the output terminal and the control terminal being connected to each other, a second transistor having an input terminal connected to the output terminal of the first transistor, and an output terminal connected to an outside, a third transistor having an input terminal connected to the output terminal of the constant-current part, a control terminal connected to the output terminal of the first transistor, and an output terminal connected to both a control terminal of the second transistor and a second terminal of the resistor, and a resistor having a first terminal connected to the output terminal of the third transistor, and a second terminal connected to an output terminal of the constant-current circuit, and wherein the resistor connected to the constant-current circuit comprises a first terminal that is connected to the input terminals of the first and second transistors, and a second terminal that is connected to the output terminal of the third transistor.

7. The apparatus of claim 6, wherein the first transistor is a junction field effect transistor, and the second and third transistors are npn bipolar transistors.

* * * * *